US005221176A

United States Patent [19]

Allen et al.

[11] Patent Number: 5,221,176

[45] Date of Patent: Jun. 22, 1993

[54] FORKLIFT BLADE COVER

[76] Inventors: John T. Allen, 506 Lark St., Athens, Tenn. 37303; Maxine G. Moffett, Rte. 2 Box 1382, Spring City, Tenn. 37381

[21] Appl. No.: 569,710

[22] Filed: Aug. 20, 1990

[51] Int. Cl.[5] ..... B66F 9/18

[52] U.S. Cl. ..... 414/785; 414/607

[58] Field of Search ..... 414/607, 785, 912; 294/67.2, 82.1; 280/47.27, 47.28; 293/142; 30/151

[56] References Cited

U.S. PATENT DOCUMENTS

| | | | |
|---|---|---|---|
| 1,836,576 | 12/1931 | Chalmers | 294/82.1 |
| 2,282,201 | 5/1942 | Neuman | 414/785 X |
| 2,690,271 | 9/1954 | Marietta | 414/785 X |
| 2,817,792 | 12/1957 | Chew | 414/785 X |
| 2,905,349 | 9/1959 | Repke | 414/664 X |
| 3,381,937 | 5/1968 | Zillman | 414/607 X |
| 3,561,628 | 2/1971 | Melin | 414/664 |
| 4,102,464 | 7/1978 | Schuster | 414/607 X |
| 4,272,220 | 6/1981 | Garcia | 414/607 |
| 4,669,949 | 6/1987 | Sutton | 414/607 X |

*Primary Examiner*—Frank E. Werner
*Assistant Examiner*—James T. Eller, Jr.
*Attorney, Agent, or Firm*—Pitts & Brittian

[57] ABSTRACT

A forklift truck blade cover constructed of a resilient compressible material that encloses and pads the toe of the forward extending lift blade of an industrial type forklift truck is provided. The blade cover provides protection from damaging pallets, piercing barrels, piercing trailer walls and creating sparks. The blade cover can be sized according to the type or brand of forklift truck being used and can be mounted on existing lift blades without modification. If the operator desires to secure the cover to the blade all that is required is drilling one or two holes in the blade for mounting bolts. The blade cover can be sized so as to prevent entry into certain types of openings in pallets, etc.

9 Claims, 2 Drawing Sheets

FORKLIFT BLADE COVER

TECHNICAL FIELD

This invention relates to the field industrial forklift trucks. More specifically this invention describes a device to cover one and preferably both of the forward extending lift blades of a forklift truck.

BACKGROUND ART

Forklift trucks are commonly used to move and/or lift materials stacked on pallets which are commonly constructed of wood. These pallets are often damaged by being struck directly by the lift blade. Such trucks are also used to lift barrels and the lift blade is capable of piercing a barrel. If the pierced barrel is containing ink or other non-hazardous materials, the result is merely time lost due to the inconvenience of cleaning a messy spill. If the barrel is containing radioactive or other hazardous materials, then the potential exists for serious injury or loss of life. Additionally, the bare metal blade can create sparks when scraped across a concrete floor or against a concrete pillar. This spark can create an explosion if it occurs in an environment laden with flammable vapors or volatile liquids.

Forklift trucks are often used to load and unload materials from the trailer of a transfer truck. Experience has shown that the side walls of the trailer are often pierced by the forward extending blades as the forklift truck is maneuvered within the trailer.

Prior art devices relating to the blades of forklift trucks are disclosed in U.S. Pat. No. 2,282,201 issued to Neuman on May 5, 1942; U.S. Pat. No. 2,690,271 issued to Marietta on Sep. 28, 1954; U.S. Pat. No. 2,817,792 issued to Chew on Dec. 24, 1957; U.S. Pat. No. 3,561,628 issued to Melin on Feb. 9, 1971; and U.S. Pat. No. 4,102,464 issued to Schuster on Jul. 25, 1978. These devices often require extensive modifications to the blade or to the carriage or are not intended to protect against sparking or puncture damage.

Accordingly, it is an object of this invention to provide a blade cover that encloses and pads the tip end, or toe, of the blade of a forklift truck with a resilient compressible material thus substantially preventing damage to pallets, barrels and trailers.

Another object of this invention to provide a blade cover that prevents the toe of the blade from striking a concrete floor or other concrete obstruction and creating sparks that could result in an explosion.

Another object of the invention is to provide a shield to assist in preventing damage to freight carried by a forklift.

It is another object of this invention to provide a blade cover that can be fitted to any forklift truck blade without extensive modification of the blade.

Still another object of this invention is to provide a blade cover that can be sized so as to prevent entry of the blade into certain type slats thereby preventing picking up of certain types of pallets.

Other objects and advantages over the prior art will become apparent to those skilled in the art upon reading the detailed description together with the drawings as described as follows.

DISCLOSURE OF THE INVENTION

In accordance with the various features of this invention, a blade cover for the forward extending lift blades of an industrial type forklift truck is provided. The blade cover is constructed of a compressible, resilient material. The blade cover encloses the toe portion of the lift blade and provides an impact absorbing toe pad that extends forward of the toe. The cover also encloses a portion of the blade rearward of the toe. By this construction, damage during the handling of materials is reduced as well as a reduction in potential creation of sparks. Moreover, the cover serves as a deterrent to assist in preventing a forklift operator from attempting to slide the forks under a barrel, refrigerator or the like.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
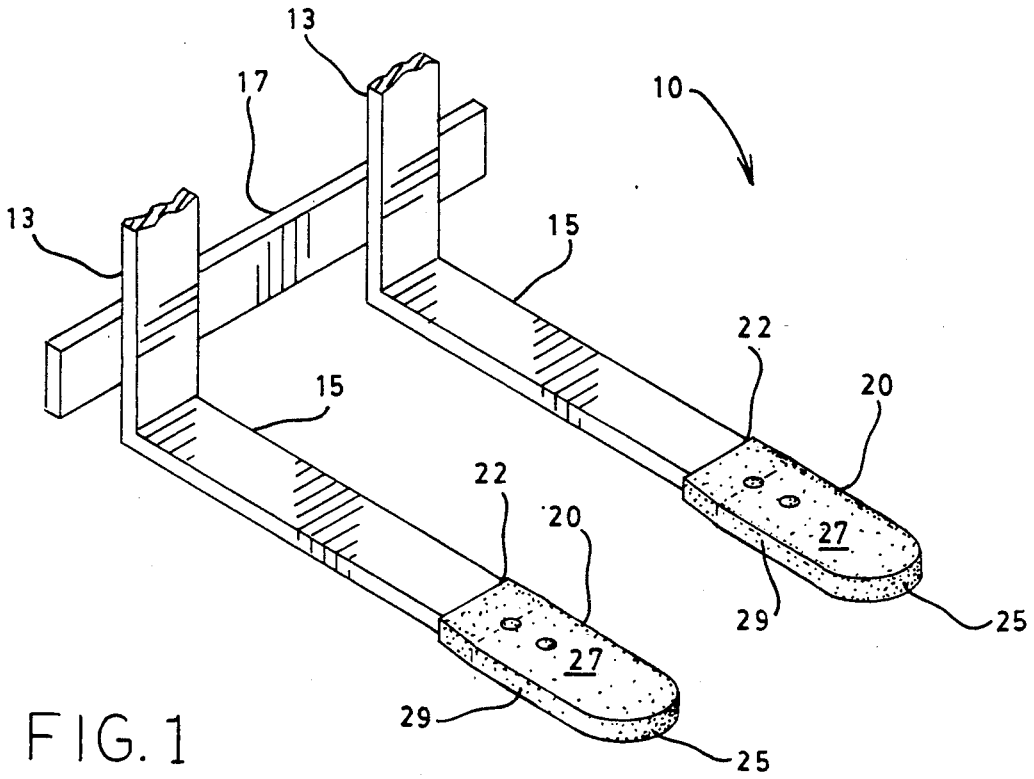
FIG. 1 illustrates a perspective view of a pair of blade covers mounted on the forward extending lift blades of a forklift truck.
Figure 2:
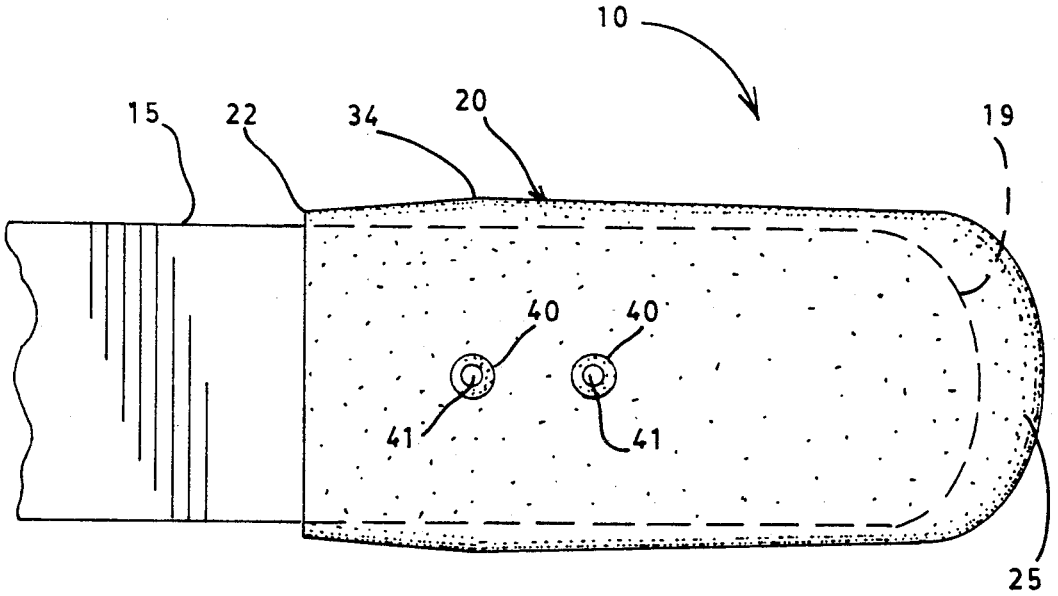
FIG. 2 illustrates a top plan view of one of the blade covers illustrated in FIG. 1.
Figure 3:
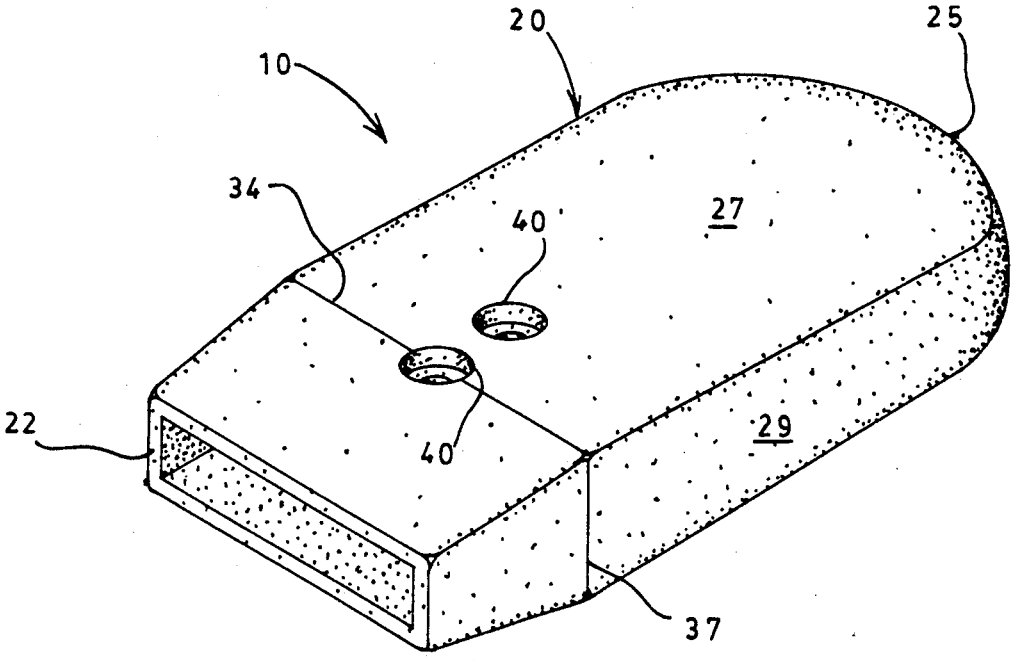
FIG. 3 illustrates a perspective view of the device illustrated in FIG. 1 removed from the forklift blade.
Figure 4:
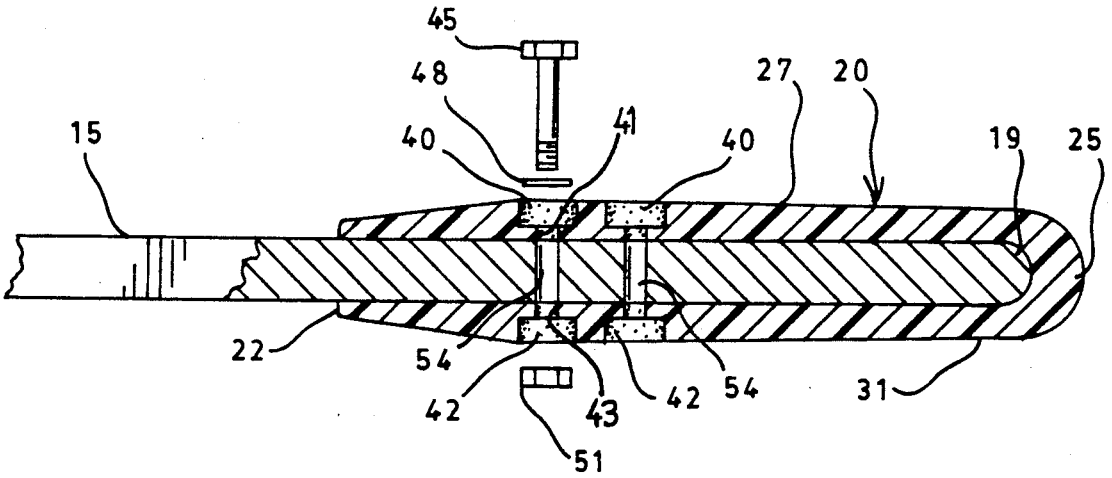
FIG. 4 illustrates a partial cross-sectional side view of the blade cover illustrated in FIG. 2.

A blade cover for enclosing and padding the toe of a forklift truck lift blade is illustrated generally at 10 in the figures. The typical forklift truck generally provides two forward extending lift blades 15 which are carried by vertical arms 13 which are in turn carried by the carriage 17. The forward most portion of lift blade 15 is the toe 19. Blade Cover 20 is constructed of a compressible, resilient material such as, but not limited to, rubber or similar synthetic substitute and consists of an open end 22, sides 29, lower surface 31, an upper surface 27 and an enclosed end that defines a toe pad 25. Open end 22 receives the toe 19 of lift blade 15. Cover 20 is pushed onto lift blade 15 until toe 19 engages the interior of toe pad 25. Those skilled in the art will recognize that blade cover 20 can be constructed in various sizes in order to accommodate the different sizes of lift blades that are available on different brands of forklift trucks.

In order to facilitate ease of entry and ease of withdrawal, blade cover 20 defines a region of maximum thickness 37 in close proximity to the open end 22. This region of maximum thickness 37 tapers longitudinally towards both the open end 22 and the toe pad 25. Similarly, a region of maximum width 34 is provided that tapers laterally towards both the open end 22 and the toe pad 25. These regions of maximum thickness and width, 37 and 34, respectively, prevent the presence of a large "shoulder" at the junction of the open end 22 and the horizontal lift blade 15 that would engage the interior edge of a pallet when horizontal lift blade 15 with cover 20 is withdrawn from the pallet. The region of maximum thickness 37 also serves as a load bearing surface. Also, these regions of maximum dimension, i.e. at 34 and 37, can have a selected value such that the forklift blades (with the covers) can be received only in selected receptors of a pallet, etc.

The blade cover 20 can be secured to the horizontal lift blade 15 by fastener means. Upper surface 27 carries at least one recessed bolt receptor 40 which is concentrically aligned with bolt hole 41. Recessed bolt receptor 40 and bolt hole 41 are in register with a recessed nut receptor 42 and lower bolt hole 43 carried by lower surface 31. While a pair of recessed bolt receptors 40 has been illustrated in a longitudinal alignment, it will be understood that no limitation is intended as to placement or quantity; those skilled in the art will recognize that a latitudinal alignment would also be an acceptable means of securing the blade cover 20 to horizontal lift blade 15.

At least one hole 54 is drilled through lift blade 15 so as to be in register with bolt hole 41. A bolt 45 in cooperation with a washer 48 is inserted into bolt hole 41 and hole 54 so that the head of bolt 45 is received within recessed bolt receptor 40. Nut 51 threadably engages bolt 45 and is received within recessed nut receptor 42. It will be understood that while a bolt and nut assembly has been described and illustrated, other fastener means including but not limited to screws and rivets are contemplated.

From the foregoing description, it will be recognized by those skilled in the art that a forklift truck blade cover offering advantages over the prior art has been provided. Specifically, the forklift truck blade cover provides a blade cover that encloses and pads the toe of the blade of an industrial forklift truck in a resilient compressible material thus substantially preventing damage to pallets, barrels and trailers thus preventing the toe of the blade from striking a concrete floor or other concrete obstruction and creating sparks that could result in an explosion. The present invention further provides a blade cover that can be fitted to any forklift truck blade without extensive modification of the blade and that can be sized so as to prevent entry of the blade into certain type slats thereby preventing picking up of certain types of pallets.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A blade cover for a forklift having at least a pair of substantially identical spaced horizontal fork members adapted to support a load, said fork members defining an upper surface, a lower surface, a medial side, a lateral side and a toe, said cover comprising:

an elongated body member constructed of a resilient compressible material for at least partially enclosing one of said fork members, said body member having an open end for receiving said fork member and a closed end for enclosing said toe and at least a portion of said upper surface, said medial side and said lateral side and said lower surface of said fork member;

a region of maximum thickness in close proximity to said open end wherein said body member tapers longitudinally from said open end and said closed end towards said region of maximum thickness thus facilitating ease of entry and withdrawal and whereby said region of maximum thickness defines a load bearing region; and a region of maximum width in close proximity to said open end wherein said body member tapers latitudinal from said open end and said closed end towards said region of maximum width thus facilitating ease of entry and withdrawal.

2. The blade cover of claim 1 wherein said body member defines at least one hole and said fork member defines at least one hole, said holes in said body member and said fork member being in register whereby said registered holes receive a fastener means for securing said cover to said fork member.

3. The blade cover of claim 2 wherein said body member further is provided with a countersink region at said hole, for receiving said fastener means.

4. A blade cover for a forklift having at least a pair of substantially identical spaced horizontal fork members adapted to support a load, said fork members defining upper and lower surfaces, medial and lateral sides and a toe, said cover comprising:

an elongated body member for at least partially enclosing one of said fork members, said body member having an open end for receiving said fork member and a closed end for enclosing said toe and at least a portion of said upper and said medial and said lateral sides of said fork member; and a region of maximum thickness in close proximity to said open end wherein said body member tapers longitudinally from said open end and said closed end towards said region of maximum thickness thus facilitating ease of entry and withdrawal and whereby said region of maximum thickness defines a load bearing region.

5. The blade cover of claim 4 wherein said blade cover also encloses said lower surfaces of one said fork member.

6. The blade cover of claim 4 wherein said blade cover further comprises fastening means for removably fixing said body member to said fork member.

7. A blade cover for a forklift having at least a pair of substantially identical spaced horizontal fork members adapted to support a load, said fork members defining upper and lower surfaces, medial and lateral sides and a toe, said cover comprising:

an elongated body member for at least partially enclosing one of said fork members, said body member having an open end for receiving said fork member and a closed end for enclosing said toe and at least a portion of said upper and said medial and said lateral sides of said fork member; and a region of maximum width in close proximity to said open end wherein said body member tapers latitudinally from said open end and said closed end towards said region of maximum width thus facilitating ease of entry and withdrawal.

8. The blade cover of claim 7 wherein said blade cover also encloses said lower surface of one said fork member.

9. The blade cover of claim 7 wherein said blade cover further comprises fastening means for removably fixing said body member to said fork member.

* * * * *